US006375304B1

(12) United States Patent
Aldrich et al.

(10) Patent No.: US 6,375,304 B1
(45) Date of Patent: Apr. 23, 2002

(54) MAINTENANCE MIST CONTROL

(75) Inventors: Charles Stanley Aldrich, Nicholasville; Benjamin Alan Askren, Lexington; John Edward Borsuk, Nicholasville; Donn Duane Bryant, Lexington; Curtis Ray Droege, Richmond; Laura Leigh Garcia, Lexington; Edward Lawrence Kiely, Lexington; Robert Flynt Strean, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/505,544

(22) Filed: Feb. 17, 2000

(51) Int. Cl.[7] ..... B41J 2/165
(52) U.S. Cl. ..... 347/35; 347/36
(58) Field of Search ..... 347/35, 25, 34, 347/36

(56) References Cited

U.S. PATENT DOCUMENTS

| | | | | |
|---|---|---|---|---|
| 3,854,399 A | | 12/1974 | Keur et al. | 101/426 |
| 4,004,513 A | | 1/1977 | Watanabe et al. | 101/489 |
| 5,406,316 A | * | 4/1995 | Schwiebert et al. | 347/18 |
| 5,428,384 A | | 6/1995 | Richtsmeier et al. | 347/102 |
| 5,528,271 A | | 6/1996 | Ebisawa | 347/34 |
| 5,552,812 A | | 9/1996 | Ebinuma et al. | 347/34 |
| 5,563,639 A | | 10/1996 | Cameron et al. | 347/34 |
| 5,617,124 A | * | 4/1997 | Taylor et al. | 347/35 |
| 5,625,398 A | | 4/1997 | Milkovits | 347/104 |
| 5,742,303 A | | 4/1998 | Taylor et al. | 347/36 |
| 5,774,141 A | | 6/1998 | Cooper et al. | 347/34 |
| 5,831,647 A | * | 11/1998 | Kawakami et al. | 347/36 |
| 5,831,655 A | | 11/1998 | Asawa et al. | 347/102 |
| 5,980,018 A | * | 11/1999 | Taylor et al. | 347/31 |

FOREIGN PATENT DOCUMENTS

| | | | | |
|---|---|---|---|---|
| JP | 404028560 A | * | 1/1992 | 347/36 |

OTHER PUBLICATIONS

Hewlett–Packard, "HP Shipping Widely Praised HP 2000C Professional Series Color Printers; Advertising Breaks," Hewlett–Packard News Releases, Hewlett–Packard Co. (Palo Alto, California), p. 5, (Sep. 11, 1998).

* cited by examiner

*Primary Examiner*—N. Le
*Assistant Examiner*—Shih-wen Hsieh
(74) *Attorney, Agent, or Firm*—D. Brent Lambert; Todd T. Taylor

(57) ABSTRACT

An ink mist controller for a maintenance station including spit louvers and a spit wheel which serve as accumulating surfaces. A flow of air directs ink mist through the louvers and around the spit wheel. Mist that is not attracted to a surface is carried to a manifold which filters, then exhausts, air to the environment, thereby preventing contamination of articles surrounding the printer. Color ink droplets are ejected onto the spit louvers. Low pressure is created between and below the louvers, which increases air and mist velocity over the entire spit zone. An unrestricted air curtain occurs on three sides of the color printhead to further control the location of mist deposit. Black ink is ejected onto the spit wheel which holds the mist deposit during evaporation. At defined intervals, the spit wheel rotates a fraction of a revolution. A scraper removes the non-volatile residue from the wheel during rotation. An air curtain is created on all four sides of the spit wheel to direct mist to this surface. As with the color ink, contaminated air is filtered prior to being exhausted to the environment.

24 Claims, 3 Drawing Sheets

MAINTENANCE MIST CONTROL

BACKGROUND OF THE INVENTION

1. Field of the Invention

The present invention relates to ink jet printers of the type which routinely fire ink droplets over a maintenance station to insure optimal drop control while printing and more particularly to controlling the dispersion of smaller ink droplets during maintenance.

2. Description of the Related Art

Ink droplet firing, as a part of a maintenance algorithm, occurs to clear the print head nozzles of contamination or to prevent ink chemistry changes at the nozzle openings due to crusting, viscosity changes, or separation of ink constituents. A common problem is the fragmentation of the ink droplet during jetting. Fragments of various sizes break from the tail of an ejected drop. The smaller fragments quickly lose momentum and may never reach the waste ink control surface of the maintenance station. The trajectory of the smaller fragments is altered by aerodynamic drag. They slow down losing momentum, thus becoming subject to uncontrolled air currents within the printer. These uncontrolled droplets behave as if buoyant until the electrostatic force of nearby surfaces attract the droplets. (Fragmented droplets, which are also controlled by aerodynamic drag, will be referred hereafter as "mist".) This results in misting on the printed page, discoloring of features inside the printer, and, possibly, discoloring of articles surrounding the printer due to contaminated air exhaust.

A traditional method of controlling ink misting during maintenance is to provide a surface near the nozzle openings for ink mist and residue to accumulate. Ideally, the distance from nozzles to accumulating surface (gap height) would be less than the "throw distance", which is defined here as the distance a fragmented droplet travels before momentum is lost. Unfortunately, the distance required for the residue accumulation resulting from these maintenance techniques and the necessary clearance between the residue and the printhead is substantially greater than the throw distance of many of the smaller particles.

SUMMARY OF THE INVENTION

The present invention utilizes an accumulating surface at throw distances that reasonably satisfy the large gap requirements of mist accumulation and clearance, while controlling the location of mist accumulation. This is accomplished with the addition of an air flow which increases droplet momentum, and/or forms a barrier, or "air curtain" to confine the mist to a corridor between the print head and a waste ink accumulating surface.

The invention comprises, in one form thereof, a process of confining and controlling waste ink jetted from an ink jet printer print head toward an adjacent waste ink accumulating surface by forcing air past the print head lateral surfaces and toward the accumulating surface to create an air curtain around a corridor from the print head to the surface to thereby minimize the dispersion of ink mist from the print head.

An advantage of the present invention is that the boundaries of ink mist migration at both the louvers and spit wheel are controlled.

Another advantage is ink droplet momentum to a waste ink accumulating surface is maintained by an air flow.

Yet another advantage is ink mist is collected prior to the exhaustion of air from the printer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
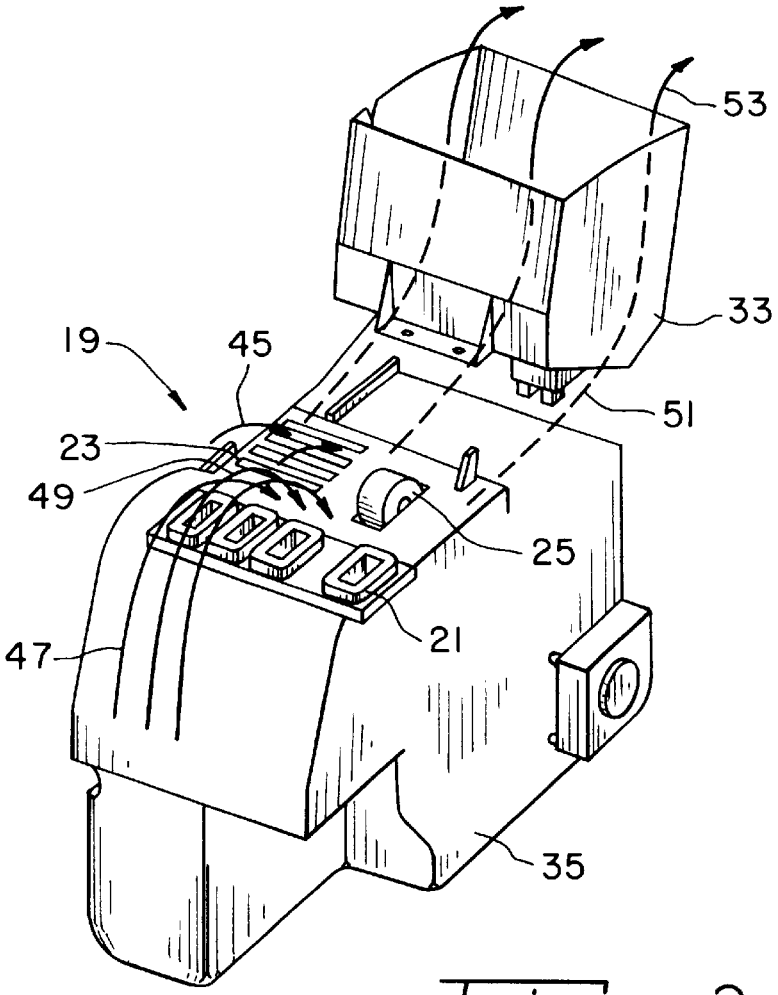
FIG. 2 is a perspective view of a portion of an ink jet printer showing a printhead maintenance station and mist control air directing arrangement.

Referring now to the drawings and particularly to FIG. 2, there is shown a portion of an ink jet printer having a maintenance station 19. During periods of nonuse, the printhead assembly assumes a parked position over the service or maintenance station 19 which includes ink caps such as 21, and a series of spaced apart inclined surfaces or louvers 23 and a spit wheel 25, each for receiving and temporarily retaining waste ink from certain of the printheads such as a black printhead or color printhead 28 of FIG. 5. Ink components are accumulated in a reservoir 35. Beneath the louvers, there may be an absorptive diaper portion (not shown) which receives the dye-based color inks dripping from the louvers 23. Air may be blown across the louvers and the diaper portion to promote evaporation of some of the more volatile components (frequently water) from the ink. Spit wheel 25 may be periodically rotationally incremented and functions to receive and dry the pigment based (black) ink. The dry ink is scraped from the wheel 25 by a scraper (not shown) and the dried ink deposited in the sump 35.

Figure 1:
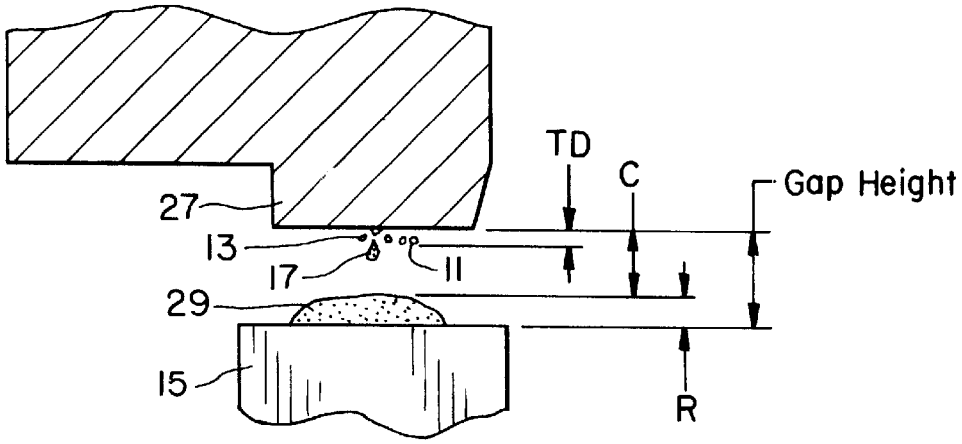
FIG. 1 is a cross-sectional view of a printhead and jetted ink receiving surface.

In FIG. 1, ink droplets such as 11, 13 and 17 are periodically jetted from the printhead 27. This purged ink accumulates on a maintenance station surface 15 as shown at 29 to a height R. Printhead 27 is spaced from the ink residue on the accumulating surface 15 by a clearance space C. Ideally, the distance (gap height, C+R) from printhead nozzles such as 27 to accumulating surface 15 would be less than the "throw distance", TD, which is defined here as the distance a fragmented droplet travels before momentum is lost, that is, $$C+R \leqq TD$$

Unfortunately, the distance required for residue accumulation and clearance is typically substantially greater than the throw distance. The smaller droplets, those which are subject to aerodynamic drag such as 11 and 13, do not satisfy this equation.

Figure 3:
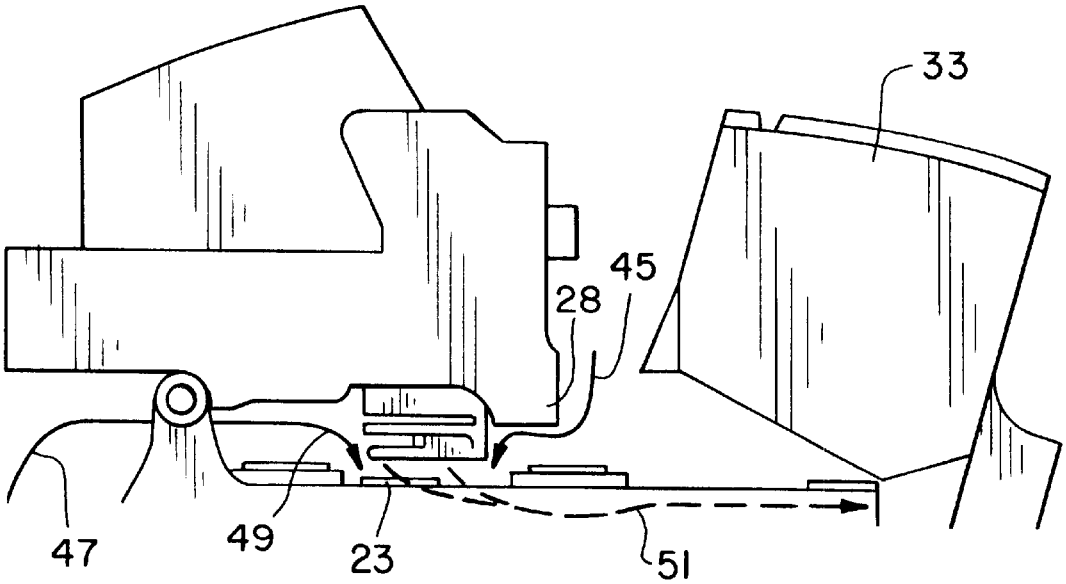
FIG. 3 is a cross-sectional view of the maintenance station and mist control air directing duct of FIG. 2 with a printhead parked at the maintenance station.

FIG. 2 shows the accumulating surfaces as a plurality of spit louvers such as 23 and the spit wheel 25. Air flows from an intake manifold 47 through the louvers 23 and around the spit wheel 25. Comparing FIGS. 2 and 3, an air curtain is formed by the airflow indicated by arrows such as 45 and 49. This curtain flows past the sides of the printhead 28 and confines the ink mist to a corridor from the printhead to an accumulating surface such as 23. This air flow directs mist to the louver 23 and wheel 25 surfaces. Mist that is not attracted to a surface is carried to the outlet manifold 33 as indicated by arrows such as 51. The manifold 33 contains a filter which filters, then exhausts, air to the environment as at 53. This prevents contamination of articles surrounding the printer.

In the illustrative embodiment, the color inks are managed differently than black ink due to formulation differences. Color ink droplets are ejected onto the spit louvers. At roughly ⅓ the mass of black ink, the color inks require greater airflow to achieve sufficient momentum. This is accomplished with the louvers. Low pressure is created below the louvers, which increases air and mist velocity over the entire spit zone. An unrestricted air curtain occurs on three sides of the color printhead as shown in FIG. 5 to further control the location of mist deposit.

Figure 5:
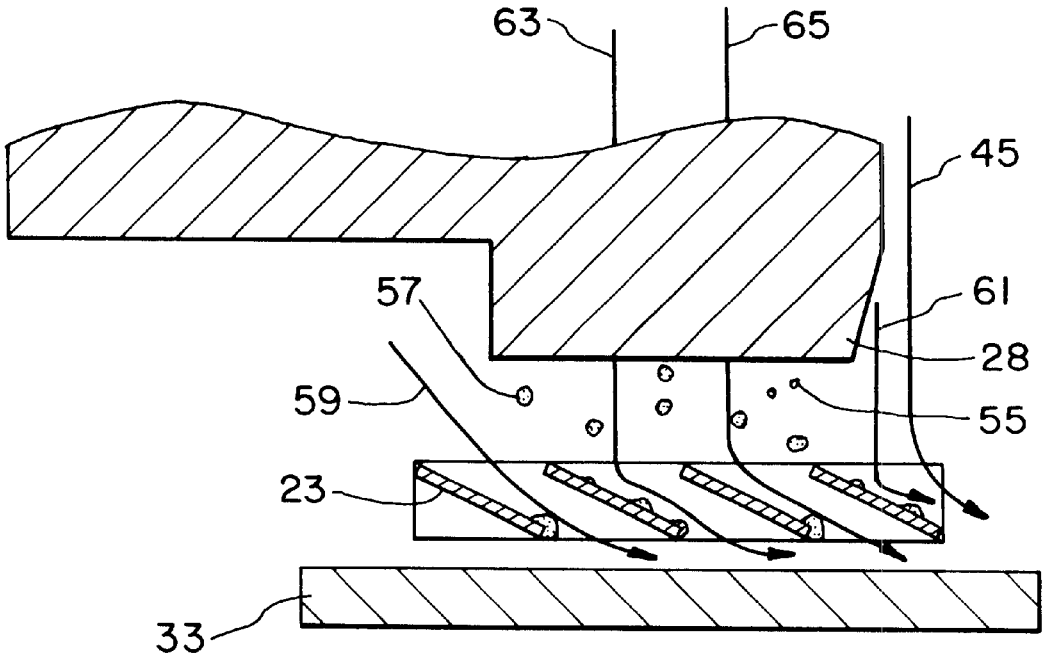
FIG. 5 is a cross-sectional view of a printhead and portions of the maintenance station of FIG. 3 taken orthogonal to FIG. 4.

In FIG. 5, the color ink printhead 28 is shown at the maintenance station superimposed over the spaced apart louvers 23. Ink droplets such as 55 and 57 are jetted from the printhead 28 to the louvers. Some of the ink droplets such as 55 are sufficiently small that they lose momentum quickly and require the added impetus of the air flow illustrated by arrows 59, 61, 63 and 65 to reach the sloping louvers 23. Additional droplet impetus is also provided by the increased velocity and correlative reduction in air pressure as the air passes between louvers. In FIG. 5, arrows 63 and 65 indicate air flowchart the printhead 28 behind the plane of the paper, arrow 59 indicates air flow to the left of the printhead and arrows such as 61 indicate air flow to the right of the printhead. Also, arrows such as 61 indicate air flow past a louver while arrows such as 59, 61 and 63 illustrate air flow passing between adjacent sloped louvers. In the preferred form, air flow substantially surrounds the peripheral portion of the gap forming an air curtain around the corridor from the printhead to the ink accumulating surface. Beneath the louvers is an absorptive diaper portion 33 which receives the dye-based color inks dripping from the louvers 23. Air blows across and between the louvers and across the diaper portion 33 to promote evaporation of some of the more volatile components (frequently water) from the ink. When color ink printhead 28 is disposed over the louvers 23, a black ink printhead is located over the spit wheel which receives and dries the pigment based ink. The dry ink is scraped from the wheel and deposited in the sump 35.

Figure 4:
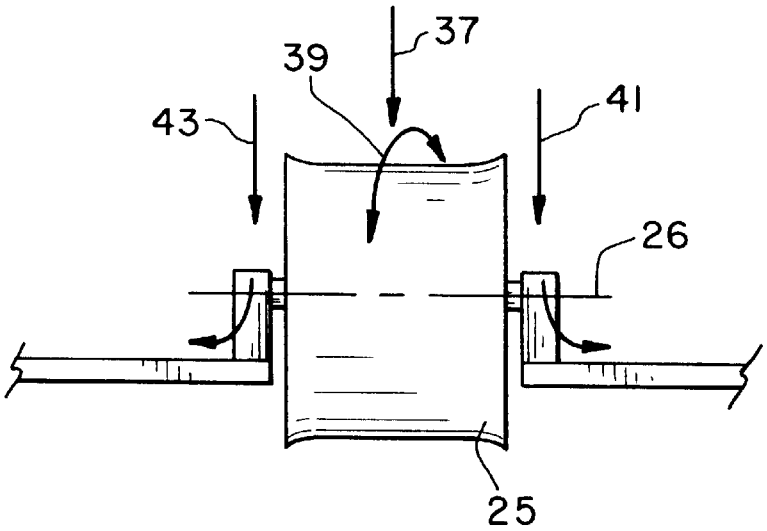
FIG. 4 is a front elevation view showing air flow paths about the spit wheel.

Black ink is ejected toward the spit wheel 25 and is confined to a corridor by the air flow illustrated by arrows 37, 39, 41 and 43 in FIG. 4. Arrows 41 and 43 indicate air flow along the two sides of the upper half of the wheel while the air flow indicated by arrow 37 toward the periphery of the wheel divides as indicated by arrow 39 to flow along the periphery in both directions. This air flow surrounds substantially all of an upper semi-circular segment of the spit wheel 25 and forms an air curtain on all four sides of the spit wheel to direct mist to the wheel. The air curtain may be created by forced air entering the system or an exhaust fan in the manifold 33. As with the color ink, contaminated air is filtered prior to exhaustion to the environment. The spit wheel holds the mist deposit during evaporation. At defined intervals, the spit wheel will rotate a fraction of a revolution about axis 26. A scraper (not shown) removes the non-volatile residue from the wheel during rotation.

In summary, the present invention utilizes accumulating surfaces 23 and 25 which are at throw distances that reasonably satisfy the large gap requirements of mist accumulation and clearance, while controlling the location of mist accumulation by providing an air flow which increases droplet momentum, and/or forms a barrier, or "air curtain" to confine the mist to a corridor between the printhead and a waste ink accumulating surface.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an ink jet printer having a maintenance station to which a printhead may be moved and ink jetted from the printhead, a maintenance station comprising:

a surface for receiving jetted ink for subsequent evaporation and containment; and an air source creating an air flow to aid transmission of the jetted ink from the printhead to the surface.

2. The maintenance station of claim 1, further including an outlet for the air flow and an ink mist filter intermediate the surface and the outlet.

3. The maintenance station of claim 1, wherein the surface comprises a plurality of spaced apart surfaces for receiving and temporarily retaining the jetted ink.

4. The maintenance station of claim 3, wherein the surfaces comprise a plurality of sloping louvers, and further comprising a diaper located beneath the louvers for receiving excess ink therefrom.

5. The maintenance station of claim 4, further including an outlet for the air flow and an ink mist filter intermediate the surface and the outlet wherein the air flows past the printhead, between louvers, through the mist filter and through the outlet.

6. The maintenance station of claim 1, wherein the surface comprises a spit wheel which may be periodically incremented to present a new peripheral surface portion to the jetted ink and to remove dried ink from another peripheral surface portion of the spit wheel.

7. The maintenance station of claim 6, wherein the air flow surrounds substantially all of an upper semi-circular segment of the spit wheel.

8. A process of confining and controlling waste ink jetted from an ink jet printer printhead toward an adjacent waste ink accumulating surface, comprising the step of:

forcing air past the printhead lateral surfaces and toward the accumulating surface to create an air curtain around a corridor from the printhead to the surface to thereby minimize the dispersion of ink mist from the printhead.

9. The process of claim 8, wherein the adjacent waste ink accumulating surface comprises a plurality of spaced apart sloping louvers, the process including forcing air past and between the louvers.

10. The process of claim 8, including the additional steps of filtering the forced air to remove any accumulated ink particles, and venting the filtered air from the printer.

11. The process of claim 8, wherein there is a gap between the printhead and the waste ink accumulating surface of a length greater than a throw distance of certain smaller jetted ink particles and the air curtain confines the certain smaller jetted ink particles to a corridor from the printhead to the surface.

12. In an ink jet printer, a process of controlling the boundaries of migration of the mist component of ink jetted from a printhead, comprising the steps of:

providing a maintenance station having an ink collection surface;

moving the printhead directly above the ink collection surface to thereby define a gap between the printhead and the ink collection surface;

jetting ink from the printhead toward the ink collection surface;

creating an air flow shroud about the periphery of the gap to prevent excess mist migration as the ink traverses the gap; and confining the mist to a corridor from the printhead to the surface with said air shroud.

13. The process of claim 12, wherein the maintenance station includes a plurality of spaced apart surfaces for receiving and temporarily retaining the jetted ink and the step of creating includes forcing air between adjacent surfaces.

14. The process of claim 12, wherein the mist is confined within said air shroud about the periphery of the gap between the printhead and the ink collection surface.

15. In an ink jet printer of the type having a maintenance station to which a printhead may be moved and ink jetted from the printhead to an adjacent surface, a maintenance station, comprising:

a gap between the printhead and the adjacent surface of a length greater than a throw distance of certain smaller jetted ink droplets; and means for aiding the transmission of the certain smaller droplets from the printhead to the surface.

16. The maintenance station of claim 15, wherein the means for aiding comprises an air source and means for directing air from the source about substantially the entire periphery of the gap to thereby create an ink droplet confining air curtain.

17. The maintenance station of claim 15, further including an outlet for the air flow and an ink mist filter intermediate the surface and the outlet wherein the air flows past the printhead, toward the surface, through the mist filter and through the outlet.

18. The maintenance station of claim 15, wherein the surface comprises a plurality of spaced apart surfaces for receiving and temporarily retaining the jetted ink and the means for aiding comprises an air flow from the printhead toward and passing between the surfaces.

19. The maintenance station of claim 15, wherein the adjacent surface comprises a spit wheel which may be periodically incremented to present a new peripheral surface portion to the jetted ink and to remove dried ink from another peripheral surface portion of the spit wheel.

20. The maintenance station of claim 19, wherein the means for aiding comprises an air flow surrounding substantially all of an upper semi-circular segment of the spit wheel.

21. The maintenance station of claim 15, wherein the means for aiding comprises a flowing air shroud substantially surrounding the peripheral portions of the gap.

22. The maintenance station of claim 15, wherein the means for aiding comprises an air flow from the printhead to the adjacent surface for supplementing the momentum of the jetted ink droplets.

23. An ink jet printer, comprising:

a printhead;

a maintenance station to which the printhead may be moved and ink jetted from the printhead; and a plurality of spaced apart sloping louvers at the maintenance station for receiving jetted ink for evaporation and subsequent containment.

24. The maintenance station of claim 23, further comprising an air flow source for creating an air flow past the printhead to and between adjacent pairs of louvers to aid in the transmission of jetted ink from the printhead to the louvers and to promote evaporation of more volatile ink components from the louver surfaces.

* * * * *